US005975339A

United States Patent [19]

Richman

[11] Patent Number: 5,975,339

[45] **Date of Patent: *Nov. 2, 1999**

[54] DISPOSABLE CONTAINERS AND INSERT RIM THEREFORE

[76] Inventor: Bruce Richman, 1208 E. Hawthorne Cir., Hollywood, Fla. 33021

[ * ] Notice: This patent issued on a continued prosecution application filed under 37 CFR 1.53(d), and is subject to the twenty year patent term provisions of 35 U.S.C. 154(a)(2).

[21] Appl. No.: 08/828,715

[22] Filed: Mar. 28, 1997

[51] Int. Cl.[6] ..... B65D 23/00

[52] U.S. Cl. ..... 220/642; 220/643; 220/666

[58] Field of Search ..... 220/640, 643, 220/666, 642, 607

[56] References Cited

U.S. PATENT DOCUMENTS

| | | | |
|---|---|---|---|
| 495,012 | 4/1893 | Brinton | 220/801 |
| 1,341,304 | 5/1920 | Ellis | 220/640 |
| 1,365,527 | 1/1921 | Mittinger | 220/640 |
| 2,266,270 | 12/1941 | Roth | 220/802 |
| 2,352,667 | 7/1944 | Tofanelli | 220/801 |
| 4,326,575 | 4/1982 | Larkin | 220/666 |
| 4,337,104 | 6/1982 | Lynn | 215/10 |
| 4,420,076 | 12/1983 | Beveridge et al. | 220/801 |
| 4,530,442 | 7/1985 | Vogel, Jr. et al. | 220/644 |
| 4,651,791 | 3/1987 | Evenson | 220/666 |
| 4,874,106 | 10/1989 | Robbins, III | 220/640 |
| 4,931,329 | 6/1990 | Sun | 220/4.03 |
| 5,174,458 | 12/1992 | Segati | 220/666 |
| 5,372,269 | 12/1994 | Sutton et al. | 220/666 |
| 5,513,820 | 5/1996 | Meyer | 220/801 |

FOREIGN PATENT DOCUMENTS

| | | | |
|---|---|---|---|
| 0218764 | 8/1988 | European Pat. Off. | 220/666 |

*Primary Examiner*—Joseph M. Moy

[57] ABSTRACT

A thin walled, plastic bottle or other container having a high rupture strength comprises a length L having a top and a bottom, and width W. The integrity of the bottle or container is compromised by a post manufacture, complete transverse cut made parallel to the width W. The top is completely severed from the bottom at a point along the length L. The top may be discarded. The bottom is comprised of, in part, collapsible side walls. A generally annular insert rim is pressure fitted onto the top-cut member of the bottom, which is formed at the cut line, thus rigidly securing the side walls and preventing any collapse thereby. A cap or closure means is matably engagable with the insert rim to seal the container.

10 Claims, 2 Drawing Sheets

DISPOSABLE CONTAINERS AND INSERT RIM THEREFORE

FIELD OF THE INVENTION

This invention relates to an improved container. More specifically, the invention comprises a new insert rim and cap for an existing disposable, thin walled, plastic bottle having a transverse cut therethrough.

BACKGROUND OF THE INVENTION

Plastic, thin and collapsible-walled bottles are a common type of container for beverages. These bottles are generally used for carbonated beverages such as carbonated sodas, and specialty waters. Once a consumer empties the contents of this type of bottle packaging, he or she disposes of it, or may cause it to be recycled. In either event, the consumer no longer has use for the bottle as a container.

The bottle of this discussion is manufactured of a thin walled plastic material. It generally has a round or annular cross section when a transverse cut is made through the width of the bottle. The plastic material used in the manufacturing of this bottle type is lightweight and has a high rupture strength. Furthermore, due to the manufacturing material coupled with the thinness of the bottle's walls, the walls are easily collapsible. Also, many manufacturers make this bottle in clear plastic. While the bottles discussed herein are used for liquid beverages such as two-liter sized soda beverages, they, or similarly situated bottles, may be used for other commodities such as cleaning chemicals or solids.

In order to utilize these mentioned bottles after the initial commodities are displaced therefrom, the present invention contemplates transversely severing the bottle into top and bottom members and inserting a rim thereon the bottom member to support the otherwise collapsible thin wall. In this regard, others have addressed the use of rims for containers. For example, the reader is directed to Great Britain Pat. No. 782,591; Belgian Pat. No. 539,920; French Pat. No. 1,149,828; U.S. Pat. No. 3,744,657, and; U.S. Pat. No. 2,065,501. While these references address the particular designs therein, they do not approach the present invention in terms of structure, function or purpose.

SUMMARY OF THE INVENTION

The present invention addresses the need to utilize an otherwise disposable thin walled container once its original contents are depleted therefrom. A thin walled, plastic bottle or other container having a high rupture strength comprises a length L having a top and a bottom, and width W. The integrity of the bottle or container is compromised by a post manufacture, complete transverse cut made parallel to the width W. The top is completely severed from the bottom at a point along the length L. The top may be discarded. The bottom is comprised of, in part, collapsible side walls. A generally annular insert rim is pressure fitted onto the top-cut member of the bottom, which is formed at the cut line, thus rigidly securing the side walls and preventing any collapse thereby. A cap or closure means is matably engagable with the insert rim to seal the container. The matable insert rim and cap may be manufactured of any suitable material, preferably some plastic synthetic or rubber and can be formed to provide a watertight and/or airtight container once fitted thereon.

Thus, it is an object of the present invention to convert an empty bottle or other container into a reusable storage container.

It is another object of the present invention to provide a reusable, ecologically friendly container to prevent the unnecessary discarding of an original, ecologically destructive container.

It is yet another object of the present invention to provide an insert rim for a thin walled, collapsible plastic container having a transverse cut completely therethrough.

It is still another object of the present invention to create an airtight or water tight container from an original thin walled, plastic bottle once its original contents are removed or discarded.

BRIEF DESCRIPTION OF THE DRAWINGS

The features embodying the present invention are illustrated in the accompanying drawing, forming a part of this application, in which.

DETAILED DESCRIPTION OF A PREFERRED EMBODIMENT

Figure 1:
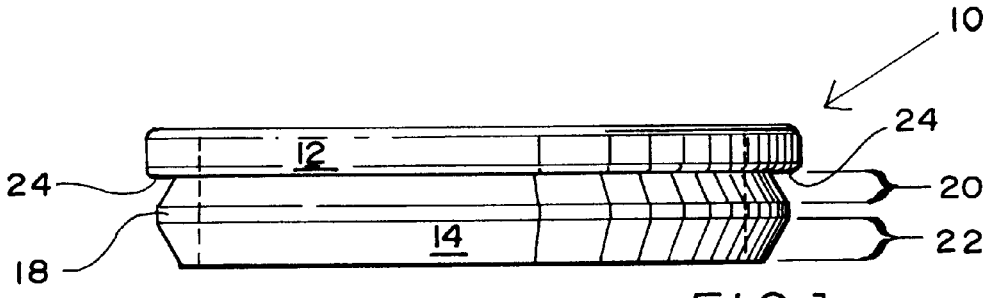
FIG. 1 is a side elevation view of the insert rim of the present invention.
Figure 2:
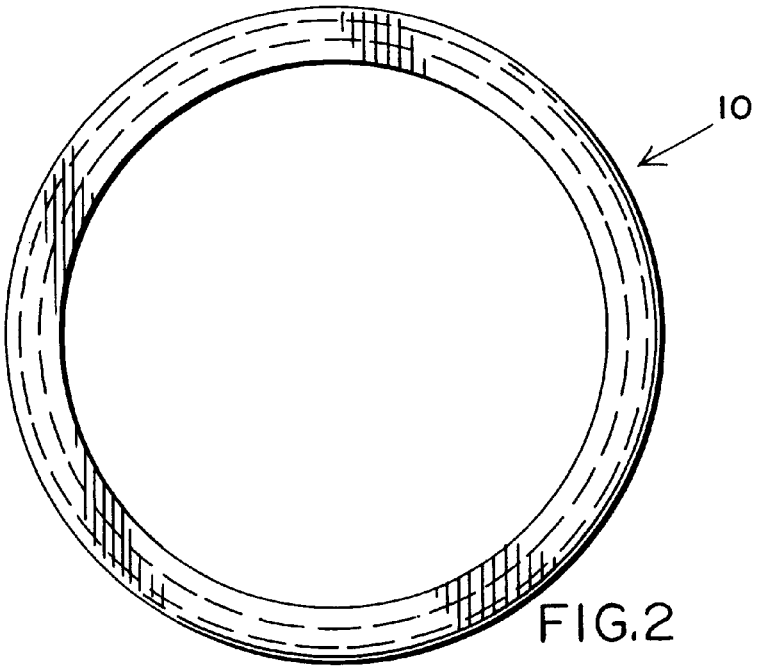
FIG. 2 is a top plan view of the insert rim of the present invention.
Figure 4:
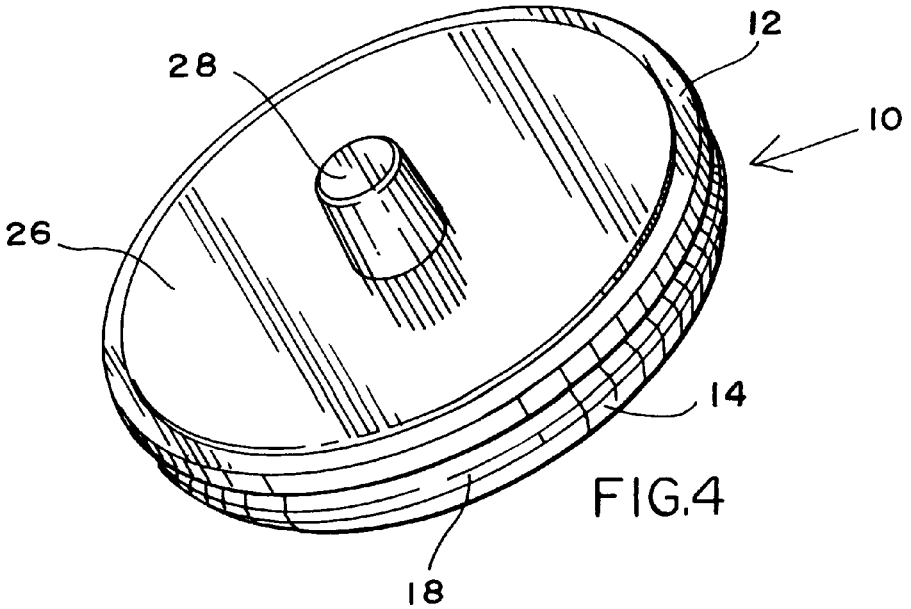
FIG. 4 is a perspective view of the insert rim of the present invention shown with a matable cap.

FIG. 1 shows a detailed depiction of a preferred embodiment of the insert rim 10 of the present invention. Therein, a container or bottle insert rim 10 is shown. The insert rim 10 comprises a flanged top portion forming a lip 12 and a lower collar 14. The shape of the insert rim 10 is variable to conform to the shape of a bottle or container 16. For purposes of example, the insert rim 10 is shown in the drawings as having a generally round or annular shape to conform to a container having a width W comprising a round cross section as seen in FIGS. 2, 3 and 4.

The collar 14 of insert rim 10 has a middle section 18, an upper section 20 and a lower section 22. From the middle section 18, the upper section tapers inwardly so that the innermost portion of the taper of upper section 20 terminates at the underside 24 of lip 12. The purpose of the taper of upper section 20 is to create the lip 12 which covers the top-cut member of the container bottom as hereinbelow described. Also from the middle section 18, the lower section 22 tapers inwardly similar to the upper section 20. The taper created on the lower section 22 permits the insert rim 10 to be matably fitted with the container 16.

Figure 3:
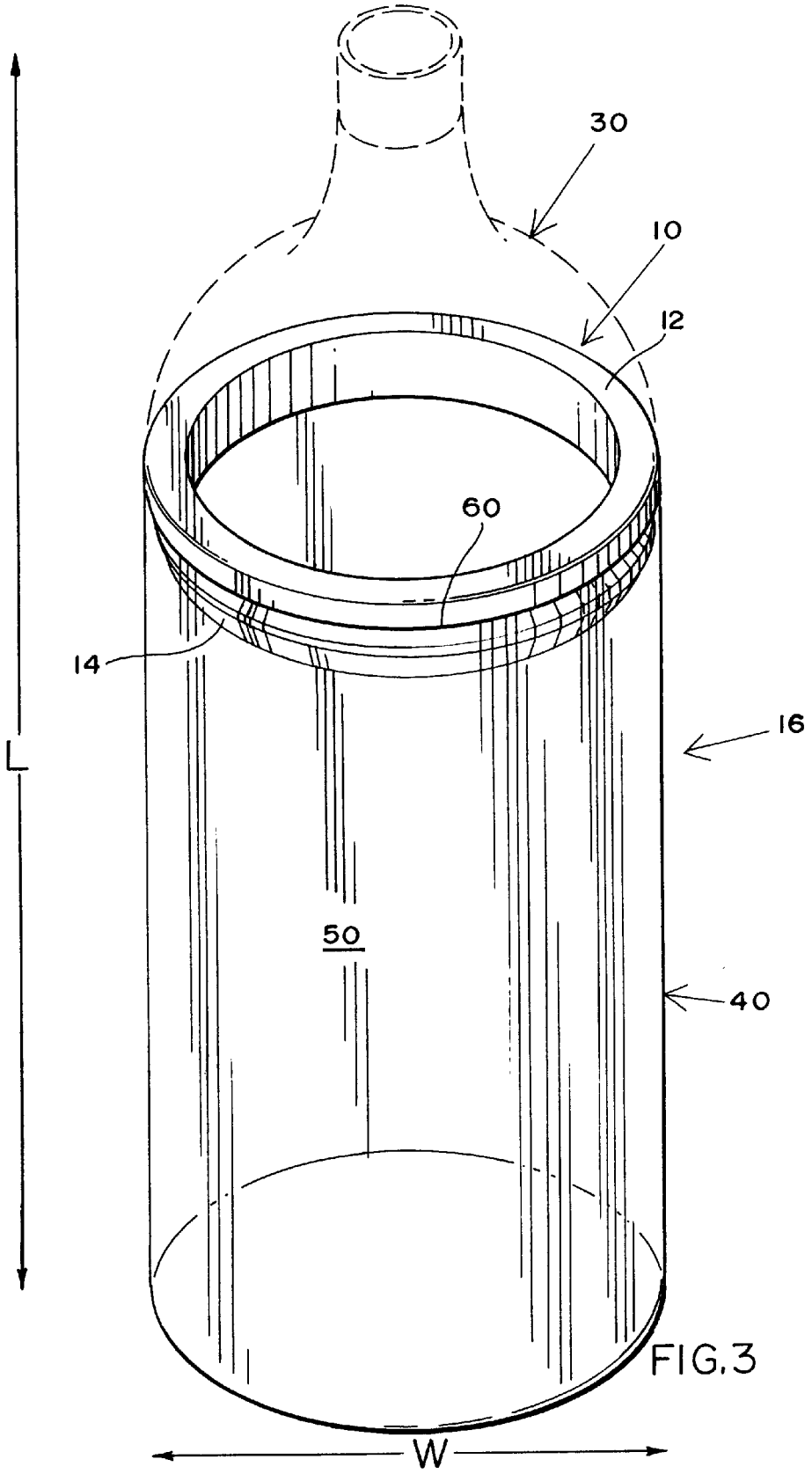
FIG. 3 is a perspective view of a bottle depicting its bottom having a top-cut member in a matable relationship with the insert rim of the present invention (with is top spout member shown in phantom lines)

Container 16 as shown in FIG. 3 has a top 30, a bottom 40 and side walls 50 along its length L, and also has a width W. The container is manufactured of a high rupture strength plastic conventionally employed to manufacture bottles such as two-liter sized soda bottles. The side walls 50 are thin and are generally collapsible. A transverse cut made parallel to the width W and at a position along the length L of the container 16 is complete, severing the top 30 from the bottom 40 of container 16. The top 30 may be discarded. The bottom 40 now is provided with a new top-cut member 60 created by the transverse cut.

The insert rim 10 is manufactured to conform and mate with the bottom 40 of container 16. The insert rim 10 is matably fitted onto the top-cut member 60 of container 16. In this regard, the diameter of the lower section 22 taper of insert rim 10 is smaller than the diameter of the cross section of bottom 40 of container 16. When the insert rim 10 is fitted onto the top-cut member 60 of bottom 40, the underside 24 of the top lip 12 of insert rim 10 rests on the top-cut member 60 of container 16. It is preferred when mating the insert rim 10 with the bottom 40 of container 16, that insert rim 10 be manually pressed onto the top-cut member 60 forming a tight pressure fit between the middle section 18 of insert rim 10 and the side walls 50 of bottom 40 of container 16. The tight pressure fit results in either an airtight and/or a water tight fit, depending upon the diameter sizing of the respective insert rim 10 and top-cut member 60. Furthermore, the insert rim 10 provides a rigid structure to support the otherwise collapsible side walls 50 at the top-cut member 60 area to maintain the container in a structurally acceptable manner capable of holding contents placed therein without spillage.

As stated above, once the insert rim 10 is pressure fitted onto the top-cut member 60 of bottom 40 of container 16, insert rim 10 is pressed until its underside 24 of top lip 12 rests upon the actual cut line of top-cut member 60 of container 16. Cap 26 is matable with the insert rim 10 to seal the opening of the container 16 (FIG. 4). A cap 26 having a watertight rubber gasket (not shown) may also be provided with insert rim 10 to result in a watertight seal between the insert rim 10 and cap 26. The top of the cap 26 has a knob 28 or other means to aid in manual manipulation to engage and disengage the cap 26 from the insert rim 10 as shown in FIG. 4.

It is intended that the description of the preferred embodiments of this invention is illustrative only. Other embodiments of the invention that are within the scope and concept of this invention are herein included within this application.

What is claimed is:

1. A plastic, non-collapsible container in combination with a matable one piece removable insert rim comprising a top lip portion and a collar, said collar further comprising an upper section, a middle section and a lower section where the lower section tapers inwardly from the said middle section, said container comprising a length having a top and a bottom, a width, and collapsible side walls, such that a top-cut member of said bottom is formed by a complete transverse cut made parallel to said width at a point between said top and said bottom, and pressure fit means to secure said insert rim onto said top-cut member of said bottom comprising said middle section exerting an outward force against the interior of said side walls substantially about said top-cut member to support rigidly said side walls.

2. A plastic container as set forth in claim 1 where said bottom is integral with said side walls.

3. A plastic container as set forth in claim 1 where said securement is airtight.

4. A plastic container as set forth in claim 1 where said securement is watertight.

5. A plastic container as set forth in claim 1 where the cross section of said bottom taken at the said top-cut member is matably relatable with the cross section of said insert rim.

6. A plastic container as set forth in claim 1 having a cap for matable engagement with said insert rim for closure of said bottom.

7. A plastic, non-collapsible container having collapsible side walls and a top-cut member opening formed therein by a post-manufacture, complete transverse cut made parallel to the width of said container, in combination with a removable one piece insert rim for fitting onto said top-cut member, said insert rim comprising a top lip portion and a collar, said collar further comprising an upper section, a middle section and a lower section where the lower section tapers inwardly from the said middle section, pressure fit means to secure said insert rim onto said top-cut member comprising said middle section exerting an outward force against the interior of said side walls substantially about said top-cut member to support rigidly said side walls, and a cap matable with said insert rim.

8. A plastic container as set forth in claim 7 where said pressure fit relationship is airtight.

9. A plastic container as set forth in claim 7 where said pressure fit relationship is watertight.

10. A plastic, non-collapsible container in combination with a matable one-piece removable insert rim comprising a top lip portion and a collar, said collar further comprising an upper section, a middle section and a lower section, said container comprising a length having a top and a bottom, a width, and collapsible side walls, such that a top-cut member of said bottom is formed by a complete transverse cut made parallel to said width at a point between said top and said bottom, and pressure fit means to secure said insert rim onto said top-cut member of said bottom comprising said middle section exerting an outward force against the interior of said side walls substantially about said top-cut member to support rigidly said side walls.

* * * * *